US009635964B1

(12) United States Patent
Martinez-Schiferl

(10) Patent No.: US 9,635,964 B1
(45) Date of Patent: May 2, 2017

(54) DISPENSING CLOSURE FOR JARS THAT STORES THE JAR MAGNETICALLY

(71) Applicant: Michael Martinez-Schiferl, Arvada, CO (US)

(72) Inventor: Michael Martinez-Schiferl, Arvada, CO (US)

(73) Assignee: Michael Martinez-Schiferl, Arvada, CO (US)

( * ) Notice: Subject to any disclaimer, the term of this patent is extended or adjusted under 35 U.S.C. 154(b) by 0 days.

(21) Appl. No.: 14/641,407

(22) Filed: Mar. 8, 2015

(51) Int. Cl.
*A47G 19/24* (2006.01)
*A47J 47/04* (2006.01)
*B65D 23/00* (2006.01)

(52) U.S. Cl.
CPC ..... *A47G 19/24* (2013.01); *A47J 47/04* (2013.01); *B65D 23/003* (2013.01); *B65D 2313/04* (2013.01)

(58) Field of Classification Search
CPC ..... A47G 19/24; A47J 47/04; A47J 43/27; B65D 23/003; B65D 25/22; B65D 25/20; B65D 83/06; B65D 1/023; B65D 1/0246; B65D 51/28; B65D 51/24; B65D 41/04; B65D 47/265; B65D 47/24
USPC ..... 220/483, 480, 476, 230, 328, 327, 212, 220/751, 253, 568; 215/44, 43, 227, 228, 215/329, 395; 206/528; 222/480, 142.3, 222/142.1
See application file for complete search history.

(56) References Cited

U.S. PATENT DOCUMENTS 131,744 A 10/1872 Cooley
1,714,368 A * 5/1929 William ..... B65D 47/263 220/253
2,029,219 A 1/1936 Bourland
3,018,924 A * 1/1962 Reed ..... A47G 19/24 222/367
3,115,267 A * 12/1963 Whitman ..... F16L 55/136 220/327
3,445,023 A 5/1969 Giessler et al.
(Continued)

FOREIGN PATENT DOCUMENTS

CA 2349889 C 10/2011

OTHER PUBLICATIONS

How to Make a Wall-Mounted Magnetic Spice Rack, The Kitchn, publication date: Nov. 16, 2009; copyright year on webpage shown: 2015, retrieved Feb. 16, 2015 from the internet: <URL: http://www.thekitchn.com/how-to-make-a-wallmounted-magn-101525>.

*Primary Examiner* — Robert J Hicks

(57) ABSTRACT

A dispensing closure comprising a closure base, a dispensing disk, a magnet, and a fastener. The magnet and closure base sandwich the dispensing disk, which are all held together with the fastener. A user fills ajar with items to be dispensed and stored and then mounts the dispensing closure onto the jar with a jar screw band. To dispense the items, the user rotates the dispensing disk to an open position and then inverts the jar. To store and display, the user rotates the dispensing disk to a closed position and then attaches the jar with the magnet to a surface attracted to a magnet. The design allows for manual seal and storage in any orientation (horizontally, vertically, or some other odd angle) and for the dispensing disks to be easily switched. The dispensing closure may further comprise a spacer, which enables easier rotation of the dispensing disk.

18 Claims, 14 Drawing Sheets

(56) References Cited

U.S. PATENT DOCUMENTS

| | | | | |
|---|---|---|---|---|
| D291,536 | S | 8/1987 | Crawford | |
| 4,832,235 | A * | 5/1989 | Palmer | A47G 19/24<br>222/370 |
| 5,027,966 | A | 7/1991 | Yadock | |
| 5,368,203 | A | 11/1994 | Friedrich et al. | |
| 5,407,107 | A | 4/1995 | Smith | |
| 7,748,569 | B2 | 7/2010 | Sunatori | |
| 8,381,949 | B2 | 2/2013 | Sunatori | |
| 8,439,209 | B2 | 5/2013 | Strollo | |
| 8,528,775 | B2 | 9/2013 | Martin | |
| 8,701,924 | B2 | 4/2014 | Dalbec | |
| 2008/0302820 | A1* | 12/2008 | Sunatori | A47G 19/24<br>222/142.3 |
| 2012/0138636 | A1* | 6/2012 | Sunatori | B65D 83/06<br>222/142.3 |
| 2014/0061199 | A1* | 3/2014 | Dalbec | B65D 51/24<br>220/483 |

* cited by examiner

DISPENSING CLOSURE FOR JARS THAT STORES THE JAR MAGNETICALLY

CROSS-REFERENCE TO RELATED APPLICATIONS

Not Applicable

STATEMENT REGARDING FEDERALLY SPONSORED RESEARCH OR DEVELOPMENT

Not Applicable

REFERENCES CITED

U.S. Patent Documents
131,744 10/1872 Cooley
2,029,219 01/1936 Bourland 221/64
3,445,023 05/1969 Giessler et al 215/40
D291,536 08/1987 Crawford D9/440
5,027,966 07/1991 Yadock 220/230
5,368,203 A 11/1994 Friedrich et al 222/179.5
5,407,107 A 04/1995 Smith 222/548
7,748,569 B2 07/2010 Sunatori 222/242.3
8,381,949 B2 02/2013 Sunatori 222/242.3
8,439,209 B2 05/2013 Strollo 211/75
8,528,775 B2 09/2013 Martin 220/23.4
8,701,924 B2 04/2014 Dalbec 220/483
(Continued)

FOREIGN PATENT DOCUMENTS

CA 2,349,889 A1 12/2009 Sunatori
(Continued)

OTHER PUBLICATIONS

How to Make a Wall-Mounted Magnetic Spice Rack, The Kitchn, publication date: Nov. 16, 2009; copyright year on webpage shown: 2015, retrieved Feb. 16, 2015 from the internet: <URL: http://www.thekitchn.com/how-to-make-a-wallmounted-magn-101525>.

BACKGROUND OF THE INVENTION

The present invention is in the technical field of closures for storage containers. More particularly, the invention relates to closures for storage containers designed to dispense items from the container and store the container magnetically.

Cooking spices and other items are often stored in containers with specially designed closures that help dispense a container's contents. Often containers, such as spice containers, are stored in kitchen cabinets or on some sort of specially designed rack, which can take up cabinet or counter space. Similar storage jars can be found in other areas of the home such as peg boards in garages that sometimes have jars mounted to them and filled with loose parts like nuts and bolts.

A wide array of canning jars are available to consumers. Most of these jars have a standard system whereby ajar closure is attached to the jar with a jar screw band.

A number of patents disclose various kinds of magnetically hanging storage systems, some with dispensing closures.

U.S. Pat. No. 8,701,924 discloses a "Portable Magnetic Storage Device and a Method of Storing Material." The storage system comprises a cap with a gasket, ajar, and a magnetic device embedded in the cap that allows for magnetic storage of material stored within the bottle sealed with the cap. The design does not include a dispensing capability without completely removing the cap from the jar and the cap design includes a gasket, which is unnecessary for enclosing and storing dry dispensable materials.

U.S. Pat. No. 8,381,949 discloses a "Magnetically-Hanging Spice Dispenser with a Continuously-Variable Hole-Size Selector." The dispenser includes a plate with magnets, a cylindrical container, a cap with dispensing holes, a magnet attached to the cap, and a circular elastic cover with holes. The elastic cover with holes rotates to align and overlap at various levels with the cap's dispensing holes to provide a continuously-variable flow. The elastic cover is also meant to provide a way of sealing the container in a stably closed position. The design requires that this elastic cover be made out of an elastic material so that it can deform into a convex protuberance. The design necessitates the deformation of the elastic cover in order to rotate-making the cap difficult to place into an open position from the close position or, over time, weakening the seal when the elastic cover is in the close position. Furthermore, material to be dispensed will accumulate under the deformed elastic cover making it even more difficult to rotate and troublesome to clean. The design is meant for mounting on a horizontal surface only.

U.S. Pat. No. 7,748,569 discloses a "Self-Sealing Auto-Aligning Magnetically-Hanging Spice Dispenser." The assembly includes a plate with magnets, a cylindrical spice container, a cap with dispensing holes and a circular cover, and a magnet attached to the cap. The circular cover can be rotated to cover a portion of the dispensing surface area. The circular cover does not act as a seal but rather as a method of providing a continuously variable flow. The design is meant for mounting on a horizontal surface only and the 'self-seal' design is not compatible with storage on a vertical surface as the spices will spill out before the seal is made.

U.S. Pat. No. 5,368,203 discloses a "Spice Rack with Magnetically Held Spice Containers." The assembly comprises a removable closure body for a spice container and a stationary tubular holder with a magnet. The spice container is detachably secured to a stationary tubular holder. The magnet is retained within a specially designed tubular holder, which can only accommodate one shape and one size and is difficult to clean.

U.S. Pat. No. 8,528,775 discloses a "Container Assembly." The spice rack assembly includes a rack and at least one container magnetically coupled to the rack. The magnet is at the base of the container on the opposite end of where the spices are dispensed through the container's lid. The design requires specially made caps and jars and therefore does not offer the possibility of a taking advantage of the wide array of jars already available on the market.

Canadian Patent 2,349,889 discloses a "Magnetically Hanging Spice/Sauce Dispenser System." The disclosure includes a hanging dispenser system comprising a horizontally mounted plate and a container assembly capable of magnetically attaching to the plate. The design lacks jar closures especially a closure capable of selecting dispensing openings in order to dispense the jars contents. The design is meant for mounting on a horizontal surface only and the 'self-seal' design is not compatible with storage on a vertical surface as the container's contents will spill out before the seal is made.

BRIEF DESCRIPTION OF THE INVENTION

The present invention is a dispensing closure that dispenses items from ajar and mounts to a surface attracted to a magnet for storage and display. The combination of features allows both the dispensing of materials (spices, small parts, and other dispensable items) and the magnetic storage of the jar container on a surface attracted to a magnet.

It is an objective of the present invention to provide a closure for the wide array of canning jars readily available to consumers, by taking advantage of existing canning jars and the method by which they are sealed with metal screw bands.

It is another objective of the present invention to provide a hanging dispenser with a manual-seal closure that allows for the storage of a jar in any orientation without the spilling of the jar's contents.

It is another objective of the present invention to provide a dispensing closure with a magnet capable of storing the jar on any surface attracted to a magnet It is another objective of the present invention to provide a dispensing closure with a variety of openings (a plurality of small holes, one large hole, or a combination thereof) in order to control the rate of flow of dispensing of the jar's contents.

It is another objective of the present invention to provide the ability to augment a canning jar in order to store and display items as an item of décor.

A dispensing closure for jars that stores the jar magnetically comprises a closure base, a dispensing disk, a magnet, and a fastener. The closure base is a substantially circular surface with a main dispensing hole cut through it. The dispensing disk is divided into two or more sections, which may or may not be of equal size. The dispensing disk's sections may include a section with one large hole and/or one or more sections with sets of smaller holes. The magnet and closure base sandwich the dispensing disk and all three are held together with the fastener, which still allows the dispensing disk to rotate. A user fills a jar with items to be dispensed and stored and then mounts the dispensing closure onto the jar with a jar screw band. To dispense the items, the user rotates the dispensing disk to an open position, selecting the desired dispensing method, and then inverts the jar. To store and display, the user rotates the dispensing disk to a closed position, manually sealing the jar, and then attaches the jar with the magnet to a surface attracted to a magnet. The design allows for attachment to a surface attracted to a magnet in any orientation (horizontally, vertically, or some other odd angle). The dispensing closure may further comprise a spacer, which provides space between the magnet and the closure base and allows for the easier rotation of the dispensing disk.

BRIEF DESCRIPTION OF THE DRAWINGS

Drawings

Figures

DRAWINGS

Reference Numerals

Figure 1:
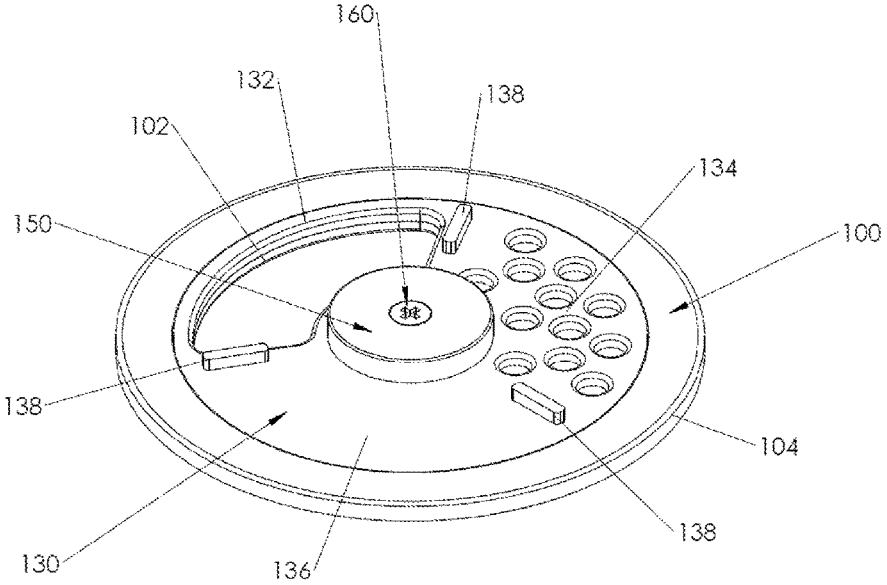
FIG. 1 is an upright perspective view of the dispensing closure.

100—closure base
102—main dispensing hole of closure base 100
104—rounded outer edge of closure base 100
130—dispensing disk
132—large dispensing hole of dispensing disk 130
134—set of smaller dispensing holes of dispensing disk 130
136—section without holes of dispensing disk 130
138—rotation tabs of dispensing disk 130
150—magnet
160—fastener
206—dispensing-disk recess of closure base 100
208—fastener hole of closure base 100
242—fastener hole through dispensing disk 130
252—fastener hole through magnet 150
262—countersunk head of fastener 160
312—recessed ring inner edge of closure base 100
314—recessed ring outer edge of closure base 100
316—fastener housing of closure base 100
590 —jar
592 —jar screw band
694—surface attracted to a magnet
744—spacer opening in dispensing disk 130
770—spacer
772—fastener hole through spacer 770
874—upper half of spacer 770
876—magnet recess of spacer 770
918—spacer member of closure base 100

DETAILED DESCRIPTION OF THE INVENTION

Figure 2:
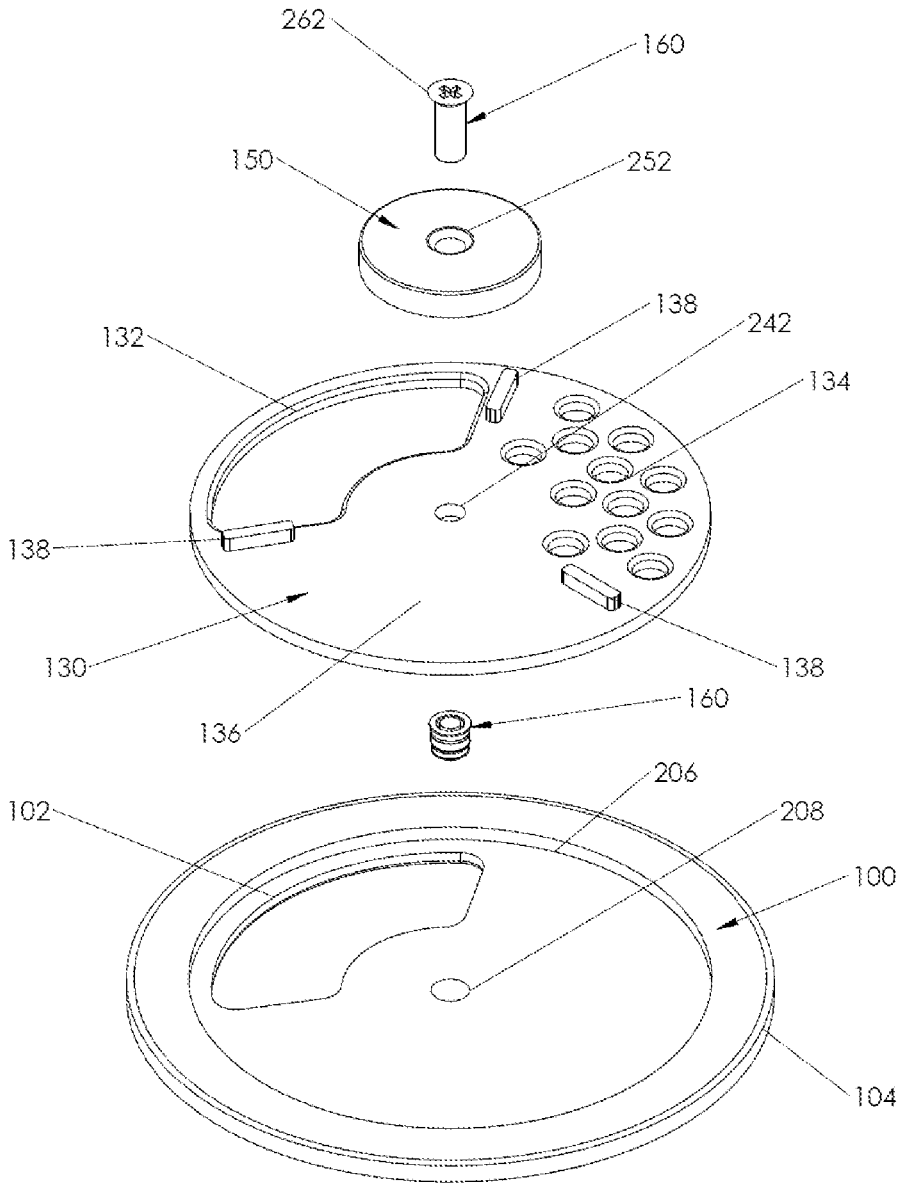
FIG. 2 is an exploded upright perspective view of the dispensing closure.

The details of the dispensing closure can be referenced in FIG. 1, FIG. 2, FIG. 3, FIG. 4, FIG. 5, FIG. 6, FIG. 7A, FIG. 7B, FIG. 8A, FIG. 8B, FIG. 9A, FIG. 9B, FIG. 10A, and FIG. 10B. FIG. 1 and FIG. 2 show an exemplary embodiment of a closure base 100, a dispensing disk 130, a magnet 150, and a fastener 160 from an upright perspective view and exploded upright perspective view, respectively. Exemplary closure base 100 is a substantially circular surface with a main dispensing hole 102 cut through it. Closure base 100 may have a dispensing-disk recess 206, in which the dispensing disk 130 is made to sit. At the center of closure base 100 is a fastener hole 208 for fastener 160. Closure base 100 may have a rounded or tapered outer edge 104 for a better fit when installed on ajar. The dispensing disk 130 is divided into two or more sections, which may or may not be of equal size. The exemplary dispensing disk 130 is shown with three sections including a single large dispensing hole 132 cut through dispensing disk 130, a set of smaller holes 134, and a section without holes 136. The sections of dispensing disk 130 may be separated with rotation tabs 138, which protrude above the top surface of dispensing disk 130 and assist with the rotation of dispensing disk 130. At the center of dispensing disk 130 is a fastener hole 242 for fastener 160. In the exemplary embodiment of the dispensing closure, magnet 150 is a disk with a diameter larger than fastener hole 242 of dispensing disk 130, so as to overlap and keep in place dispensing disk 130 sandwiched between magnet 150 and closure base 100. Magnet 150 may have fastener hole 252 for fastener 160 and that fastener hole 252 may be countersunk so that the top of fastener 160 sits flush with the top of magnet 150. Fastener 160 may be used to hold together all assembly components or some subset of assembly components with others fastened with an adhesive or by other means. Fastener 160 may be any number of fasteners including but not limited to a screw and threaded insert (shown), screw and nut, rivet, brad, split pin, pin and clip, or a self-attaching fastener.

Figure 3:
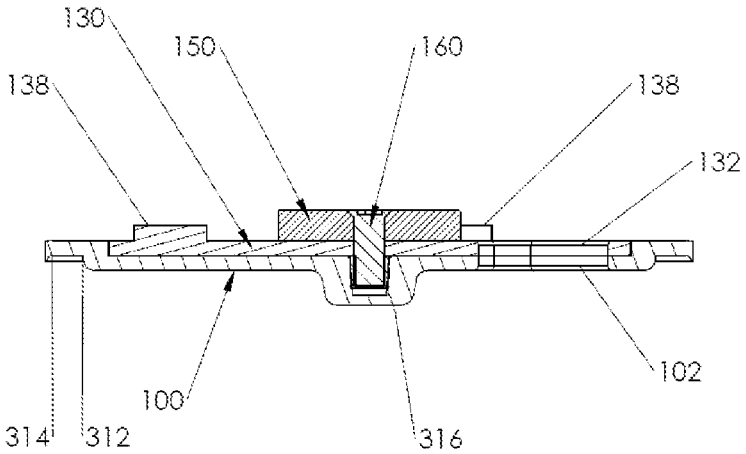
FIG. 3 is a cross-section view of the dispensing closure.

FIG. 3 shows a cross-section view of the dispensing closure. This figure provides a better view of how the exemplary embodiment's components fit together. Shown are closure base 100 with main dispensing hole 102. Closure base 100 may have recessed ring inner edge 312 and recessed ring outer edge 314 in order to form a better seal with a jar. Closure base 100 may also have a closure base fastener housing 316, which may enclose a portion of the exemplary fastener 160—FIG. 3 shows a screw and threaded insert as the exemplary fastener 160. Seated on top of closure base 100 is dispensing disk 130. Dispensing disk 130 may have large dispensing hole 132 and rotation tabs 138. On top of the dispensing disk is magnet 150. The diameter of magnet 150 is larger than the diameter of fastener 160; magnet 150 and closure base 100 sandwich dispensing disk 130. The assembly is held together with fastener 160.

Figure 4:
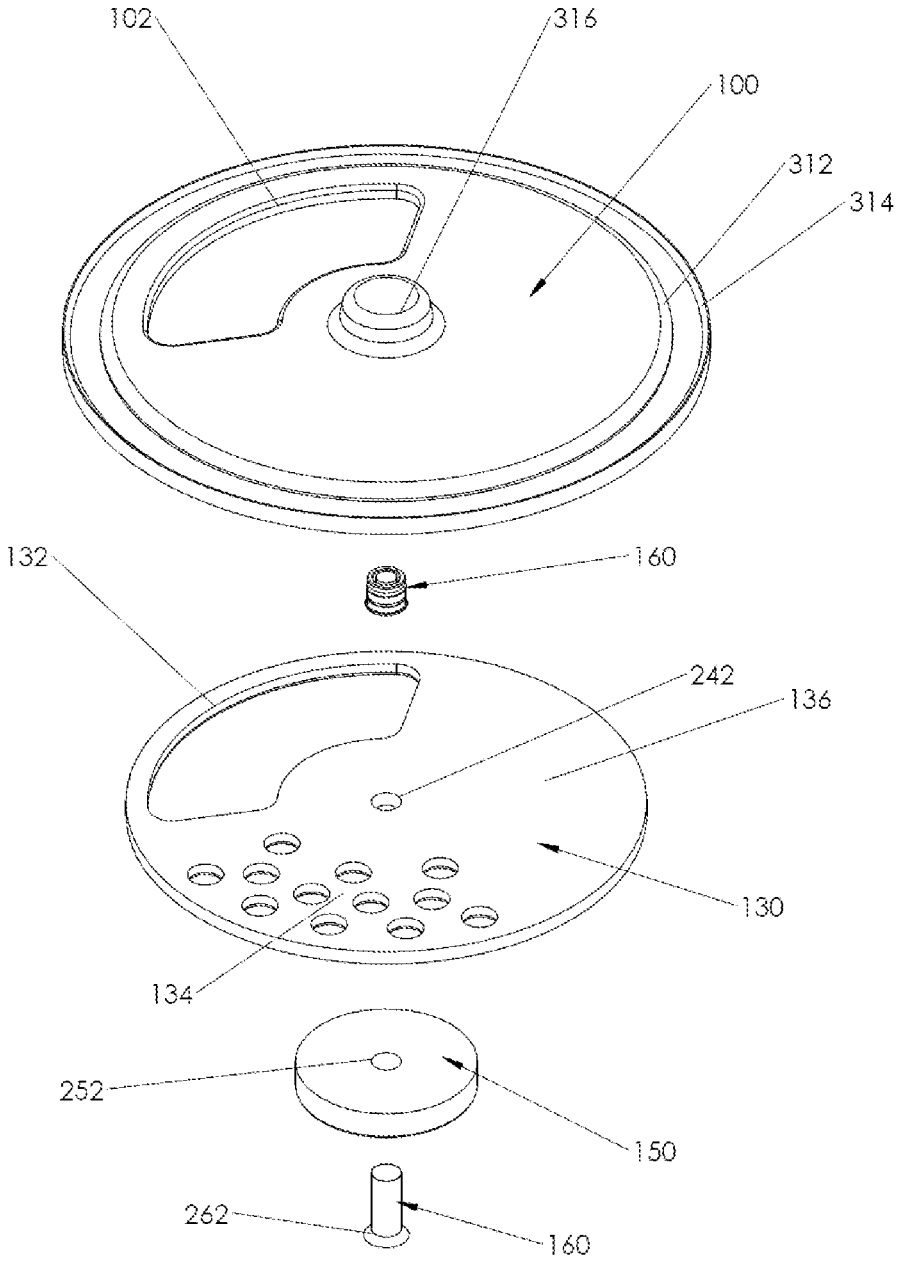
FIG. 4 is an exploded flipped perspective view of the dispensing closure.

FIG. 4 shows closure base 100, dispensing disk 130, magnet 150, and fastener 160 from an exploded flipped perspective view. The bottom of closure base 100 may have recessed ring inner edge 312 and/or recessed ring outer edge 314, which are made to wrap around the top lip of a jar and form a seal. Also shown is the main dispensing hole 102 cut through closure base 100 and fastener housing 316. Dispensing disk 130 is also shown with flipped perspectives of the two or more sections in which dispensing disk 130 may be divided. The example dispensing disk 130 shown includes a single large dispensing hole 132, a set of smaller holes 134, and a section without holes 136. Magnet 150 is a disk with a diameter larger than fastener hole 242 of dispensing disk 130 as to overlap and keep in place dispensing disk 130, which is sandwiched between magnet 150 and closure base 100. Magnet 150 may have fastener hole 252 for fastener 160. Fastener 160 may be used to hold together all assembly components or some subset of assembly components with others fastened with an adhesive or by other means. Fastener 160 may have countersunk head 262 and fastener 160 is made to lie flush with the top surface of the upper-most component in the assembly subset. Fastener 160 may be any number of fasteners including but not limited to a screw and threaded insert (shown), screw and nut, rivet, brad, split pin, pin and clip, or a self-attaching fastener.

Figure 5:
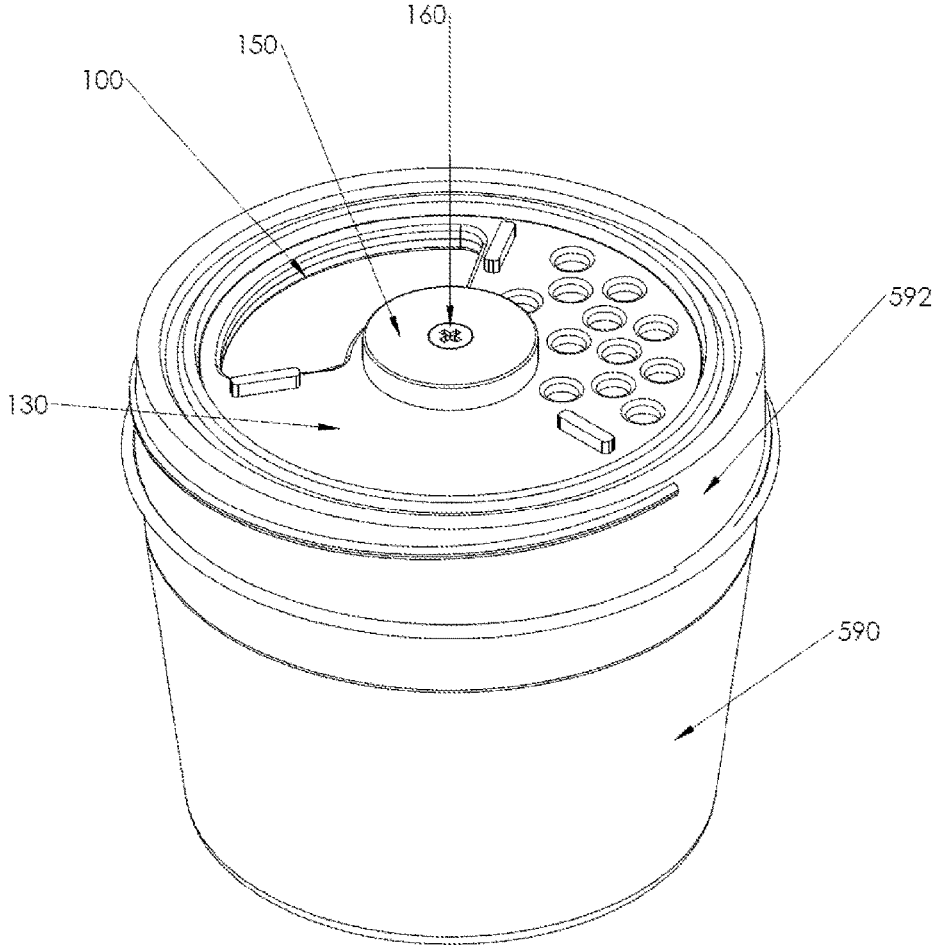
FIG. 5 is an upright perspective view of the dispensing closure installed on a jar.

FIG. 5 is a perspective view of the dispensing closure installed on ajar 590. Shown are closure base 100, dispensing disk 130, magnet 150, and fastener 160 secured to the top of jar 590 with a jar screw band 592.

Figure 6:
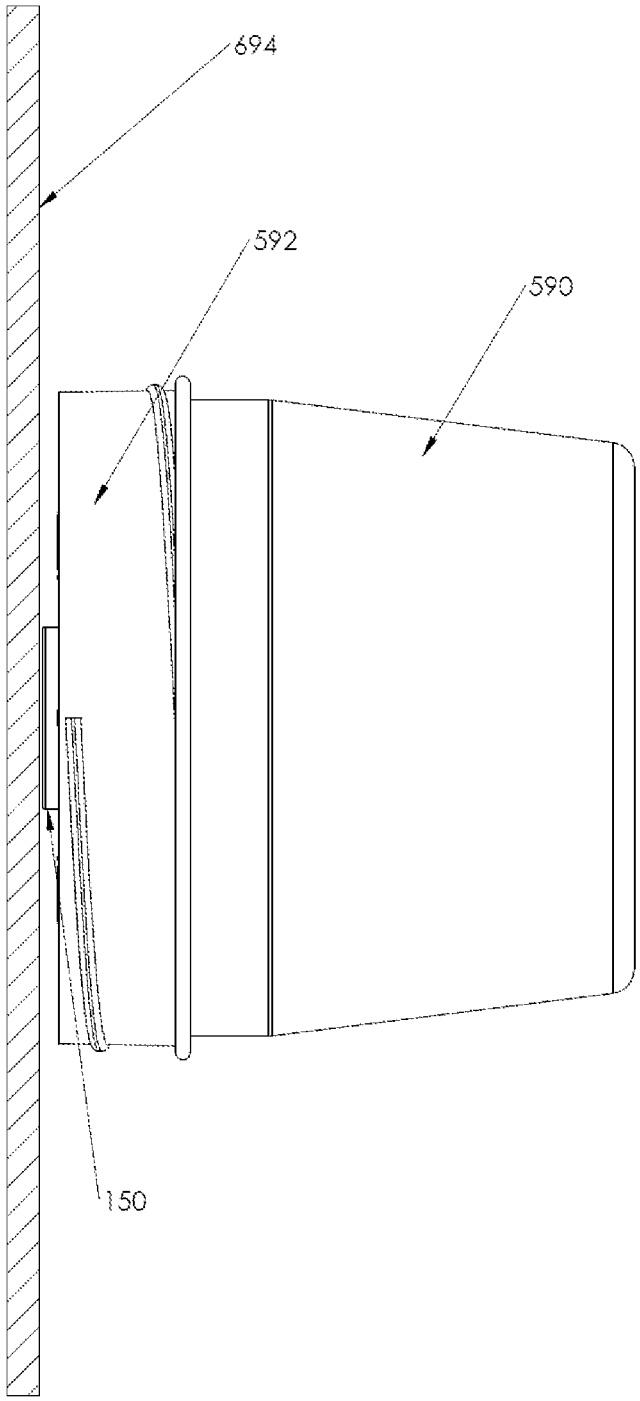
FIG. 6 is a side view of the dispensing closure installed on ajar and attached to a surface attracted to a magnet.

FIG. 6 is a side view of the dispensing closure installed on jar 590. Jar screw band 592 holds the dispensing closure secure on top of jar 590. Shown is the top of magnet 150, which protrudes above the top of the jar screw band 592.

Figure 7A:
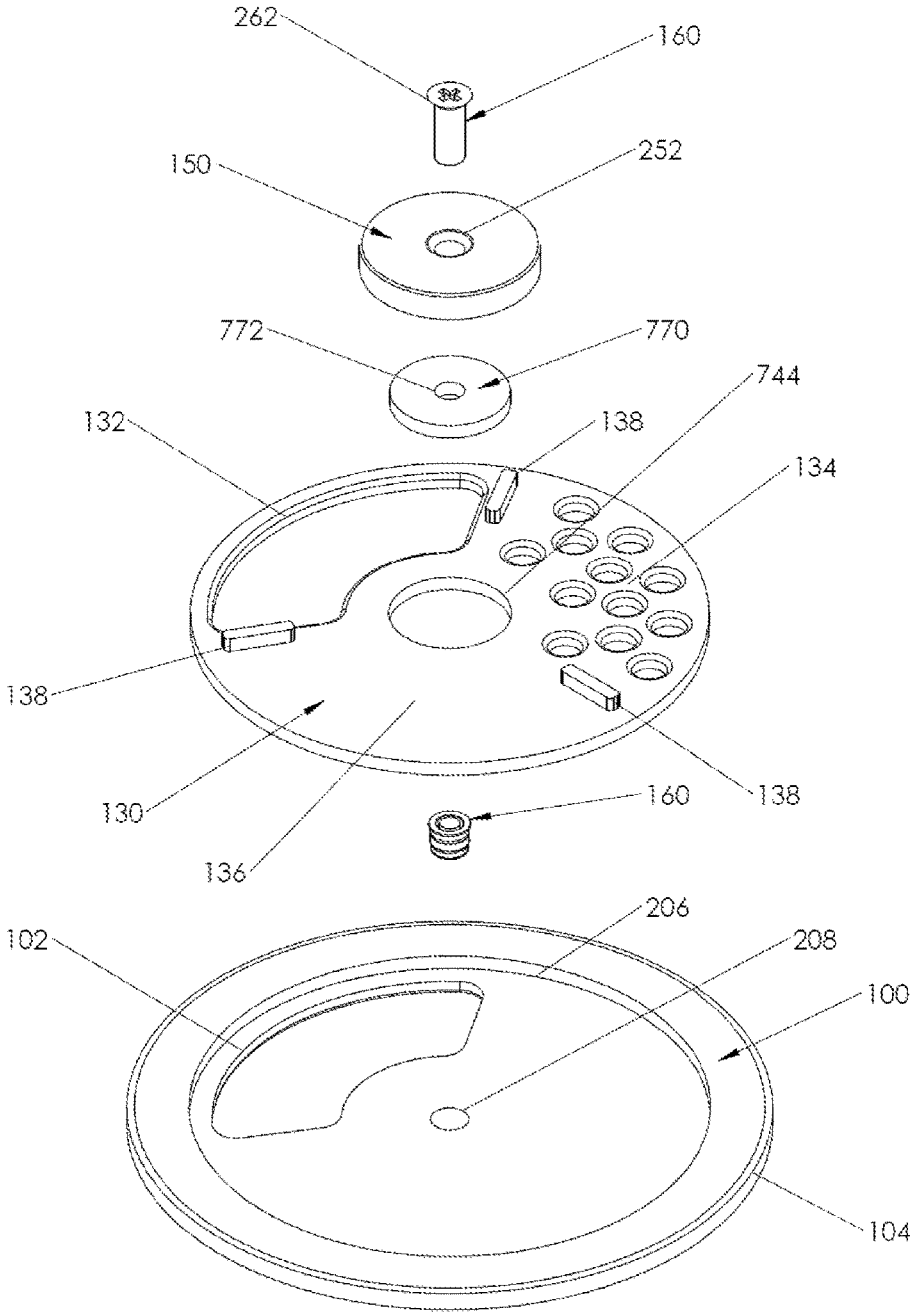
FIG. 7A is an exploded upright perspective view of an alternative embodiment of the dispensing closure.
Figure 7B:
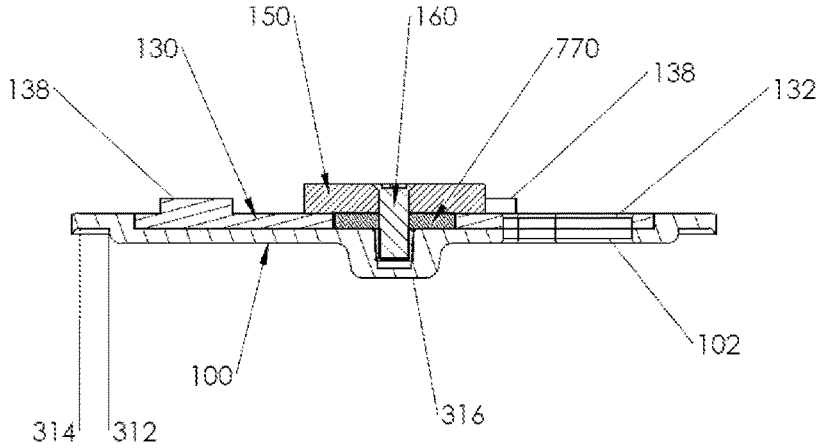
FIG. 7B is a cross-section view of an alternative embodiment of the dispensing closure.

FIG. 7A and FIG. 7B show an alternative exemplary embodiment of the dispensing closure. FIG. 7A is an exploded upright perspective and 7B is a cross-section perspective of the dispensing closure comprising one additional component, an exemplary spacer 770. The exemplary spacer 770 is a substantially cylindrical disk with a hole 772 for fastener 160. The exemplary embodiment of spacer 770 is smaller in diameter than magnet 150. The thickness of the spacer 770 is slighter greater than the thickness of dispensing disk 130. Spacer 770 holds apart magnet 150 and closure base 100, which sandwich dispensing disk 130; by providing an additional amount of space, spacer 770 helps facilitate the rotation of dispensing disk 130. The exact thickness of spacer 770 may be dependent on the materials and surface finishes of magnet 150 and closure base 100.

Figure 8A:
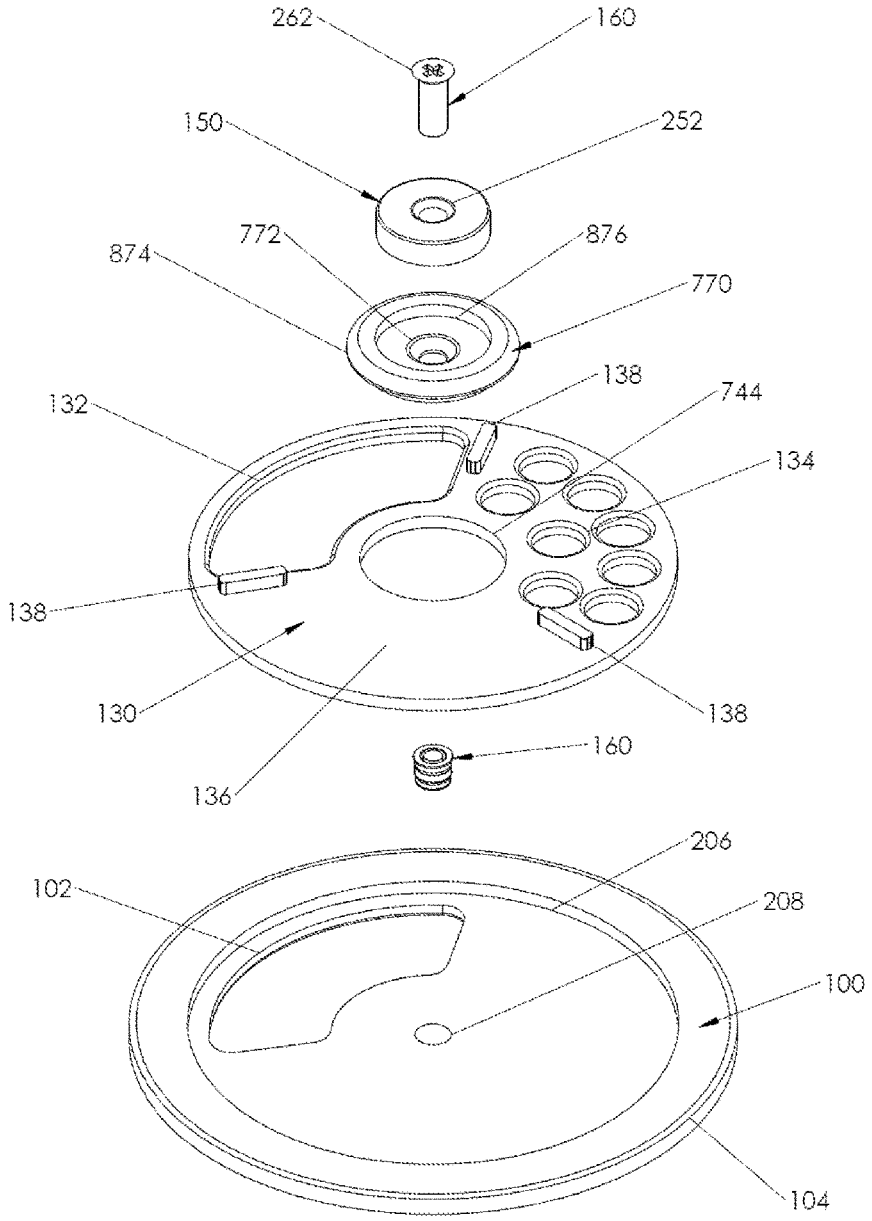
FIG. 8A is an exploded upright perspective view of an alternative embodiment of the dispensing closure.
Figure 8B:
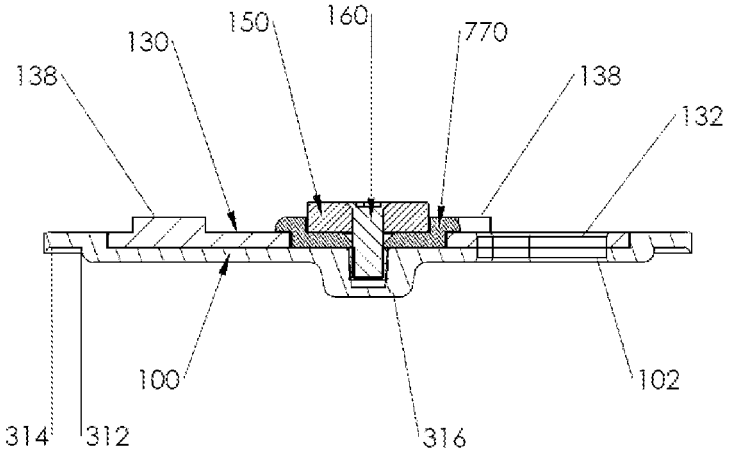
FIG. 8B is a cross-section view of an alternative embodiment of the dispensing closure.

FIG. 8A and FIG. 8B show another alternative exemplary embodiment of the dispensing closure. FIG. 8A is an exploded upright perspective and 8B is a cross-section perspective of the dispensing closure comprising, again, one additional component, another exemplary spacer 770. The exemplary spacer 770 in FIG. 8A and FIG. 8B has a larger diameter than magnet 150. The upper half 874 of spacer 770 has a larger diameter than hole 744 of dispensing disk 130 so that it overlaps and keeps in place dispensing disk 130. The upper half 874 of spacer 770 may have a rounded or tapered edge. Spacer 770 also has magnet recess 876, in which magnet 150 is inserted. Spacer 770 has a fastener hole 772 for fastener 160—the hole may be countersunk to allow fastener 160 to lay flush with the top of magnet recess 876 of spacer 770 so that magnet 150 may be alternatively fastened to the assembly with an adhesive. The bottom half 874 of spacer 770 is substantially cylindrical and the thickness of the bottom half 874 of spacer 770 is slighter greater than the thickness of dispensing disk 130. The upper half of spacer 770 and closure base 100, which sandwich dispensing disk 130, helps facilitate the rotation of dispensing disk 130. The exact thickness of the bottom half 874 of spacer 770 may be dependent on the materials and surface finishes of spacer 770 and closure base 100. Additionally, FIG. 8A and FIG. 8B demonstrate another alternative embodiment of dispensing disk 130 in which the section with a set of smaller holes 134 are different from the previous exemplary embodiments in that the holes are larger and there are fewer of them.

Figure 9A:
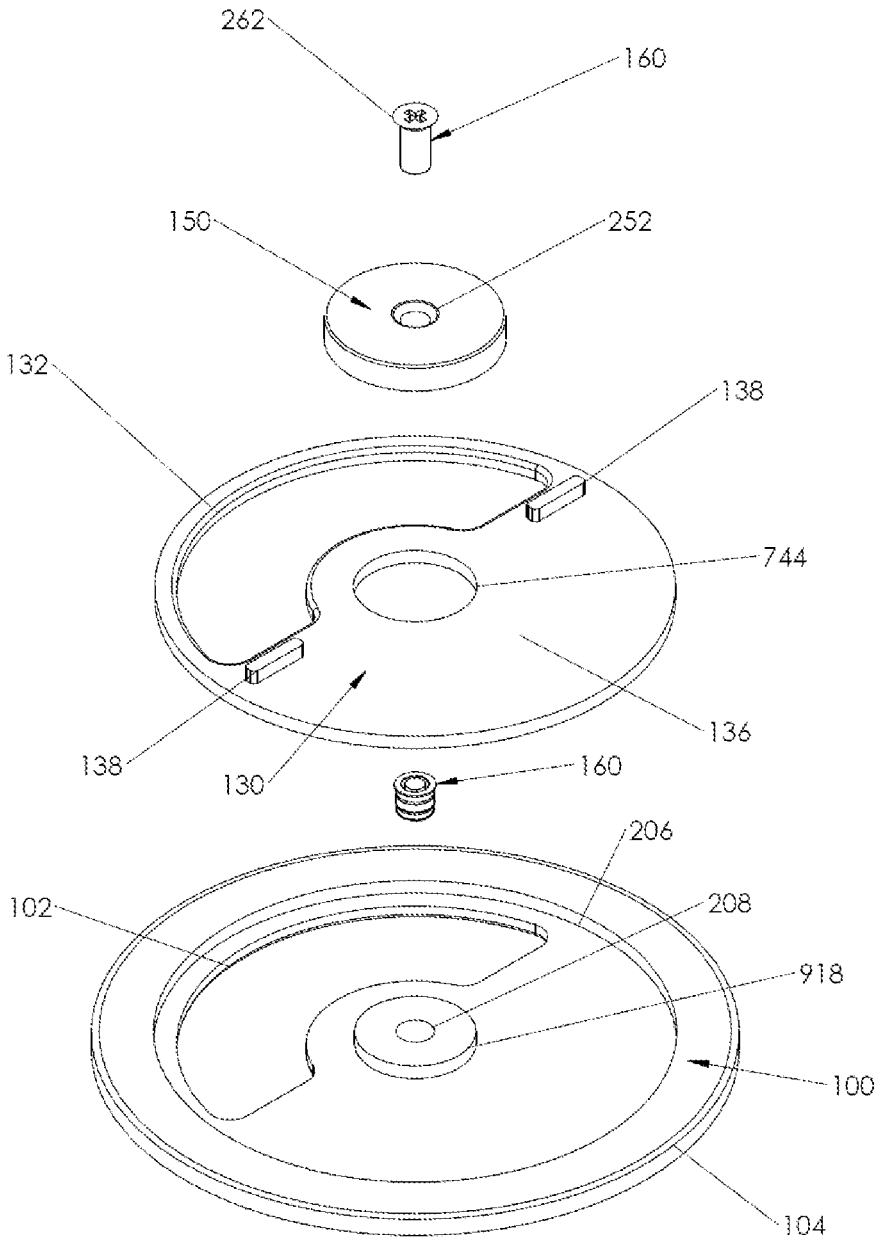
FIG. 9A is an exploded upright perspective view of an alternative embodiment of the dispensing closure.
Figure 9B:
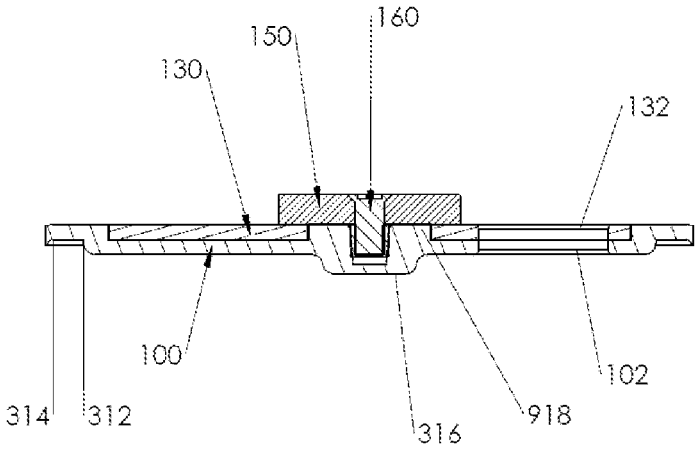
FIG. 9B is a cross-section view of an alternative embodiment of the dispensing closure.

FIG. 9A and FIG. 9B show another alternative exemplary embodiment of the dispensing closure. FIG. 9A is an exploded upright perspective and 9B is a cross-section perspective of the dispensing closure in which closure base 100 comprises one additional component, an exemplary spacer member 918. The exemplary spacer member 918 is a substantially cylindrical disk with a hole 208 for fastener 160. Spacer member 918 is smaller in diameter than magnet 150. The thickness of the spacer member 918 is slighter greater than the thickness of dispensing disk 130. Spacer member 918 holds apart magnet 150 and the rest of the main body of closure base 100, which sandwich dispensing disk 130; by providing an additional amount of space, spacer member 918 helps facilitate the rotation of dispensing disk 130. The exact thickness of spacer member 918 may be dependent on the materials and surface finishes of magnet 150 and closure base 100. Additionally, FIG. 9A and FIG.

9B demonstrate another alternative embodiment of dispensing disk 130 and closure base 100. The exemplary dispensing disk 130 only has two sections: one section has a single large dispensing hole 132 and the other section is without holes 136. The two sections may be separated with rotation tabs 138. The main dispensing hole 102 in closure base 100 has been re-proportioned to be similar in size to the single large dispensing hole 132 of dispensing disk 130.

Figure 10A:
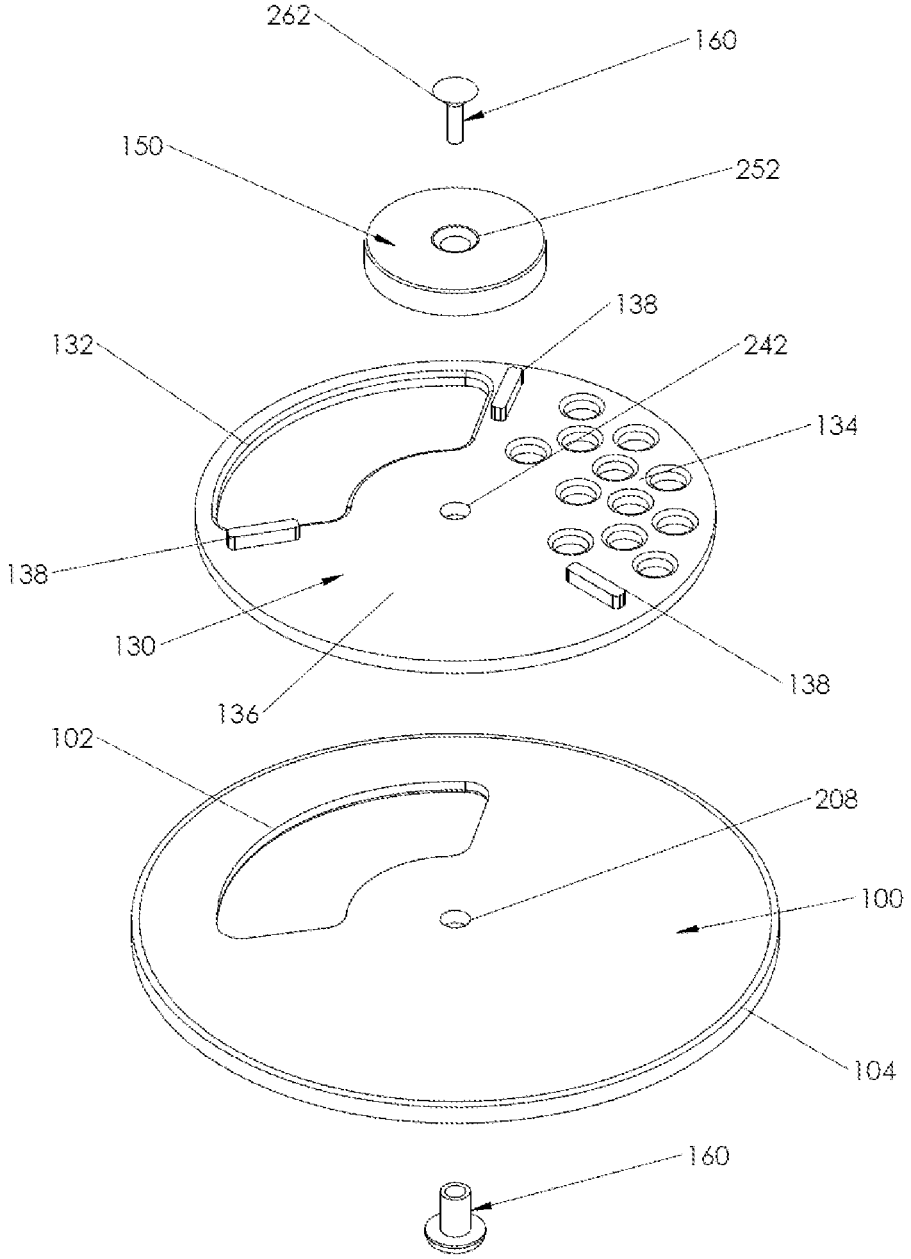
FIG. 10A is an exploded upright perspective view of an alternative embodiment of the dispensing closure.
Figure 10B:
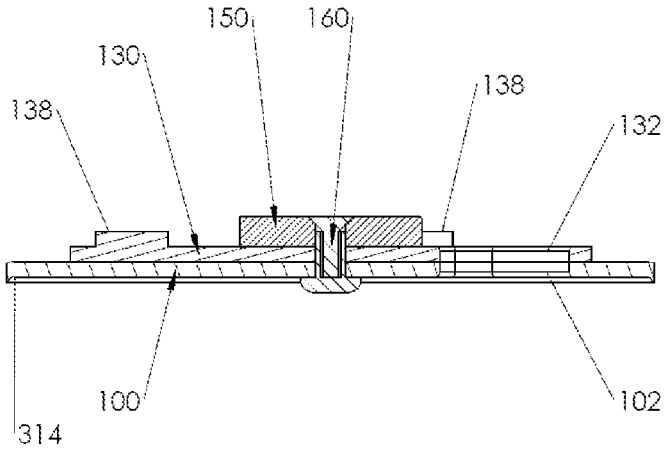
FIG. 10B is a cross-section view of an alternative embodiment of the dispensing closure.

FIG. 10A and FIG. 10B show yet another alternative exemplary embodiment of the dispensing closure. FIG. 10A is an exploded upright perspective and 10B is a cross-section perspective of the dispensing closure. There are several differences in this exemplary embodiment compared to those presented previously. First, this exemplary embodiment shows a tubular rivet as fastener 160. Second, there is no dispensing disk recess 206 in closure base 100. Third, the exemplary closure base 100 only has recessed ring outer edge 314 and lacks recessed ring inner edge 312 (shown in previous exemplary embodiments).

In more detail, the user would fill the jar 590 with items to be dispensed by removing jar screw band 592 and the dispensing closure from the top of jar 590, fill jar 590 with the item or items to be dispensed, and re-install the dispensing closure on jar 590 with jar screw band 592. Alternatively, the user could use rotation tabs 138 to align large dispensing hole 132 of dispensing disk 130 with main dispensing hole 102 of closure base 100, fill jar 590, and again use rotation tabs 138 of dispensing disk 130 to rotate the disk so that the section without holes 136 covers main dispensing hole 102 of closure base 100, creating a manual seal.

For storage and display, the user would ensure that dispensing disk 130 was rotated with rotation tabs 138 so that the section without holes 136 covers main dispensing hole 102 in closure base 100, creating a manual seal method of sealing the container with the dispensing closure. This manual seal allows the user to seal and then store the jar and dispensing assembly in any orientation (horizontally, vertically, or some other odd angle). After manually sealing the jar, the top of magnet 150 is placed on a surface attracted to a magnet 694 for storage as shown in FIG. 6. When the item within the jar 590 is needed, the user removes the assembly from surface attracted to a magnet 694 and, holding jar 590 in an upright position, uses rotation tabs 138 to rotate dispensing disk 130 until the desired dispensing method is selected, including large dispensing hole 132 or set of smaller holes 134 of dispensing disk 130. Then the assembly is inverted so that the items within jar 590 can pass through main dispensing hole 102 and either large dispensing hole 132 or set of smaller holes 134.

The dispensing closure may also be designed so that the user may remove fastener 160 and replace dispensing disk 130 with a different dispensing disk 130 that has different size holes, allowing the user to customize the rate of flow of the items dispensed from the jar.

In further detail, main dispensing hole 102 of closure base 100 and the large dispensing hole 132 of dispensing disk 130 may be the same size and shape and may take up to half of the disk area in closure base 100 and dispensing disk 130 when dispensing disk 130 only has two sections (as is shown in FIG. 9A and FIG. 9B). The dispensing disk 130 set of smaller holes 134, when present, may be substantially circular or another shape.

Closure base 100, dispensing disk 130, fastener 160, and spacer 770 may be made from plastic, rubber, metal, wood, ceramic, glass, or a variety of other rigid or semi-rigid materials. Magnet 150 may be made from any magnetic material or a material attracted to a magnet.

Other alternative embodiments of the present invention include:

- Dispensing disk 130 with only two sections or four or more sections. For example, in a two-section version of the present invention the sections could be either a large dispensing hole and a section without holes, or a section with a smaller set of holes and a section without holes. As another example, dispensing disk 130 could be divided into four sections with dispensing disk 130 having a large dispensing hole 132, a set of smaller holes with a larger diameter, a set of smaller holes with a smaller diameter, and a section without holes 136.
- Jar screw band 592 designed as part of the closure itself and not as a separate component.
- A design where main dispensing hole 102 and/or large dispensing hole 132 include a flat edge for leveling a measuring spoon.
- A design where the user may remove fastener 160 and replace dispensing disk 130 with a different dispensing disk 130 that has a different size set of smaller holes 134, allowing the user to customize the rate of flow of the items dispensed from the jar.
- A design of closure base 100 that has recessed ring inner edge 312 and/or recessed ring outer edge 314 or neither edge.
- A closure assembly where some or all of the components are held together with a combination of fasteners including adhesive, a self-attachment mechanism, screw and threaded insert, screw and nut, rivet, brad, split pin, a pin and clip, or other similar fasteners.
- A closure base 100 with fastener housing 316, which holds a portion of a multi-piece fastener 160. For example, if fastener 160 were a screw and nut, then fastener housing 316 may be designed to hold the nut in place.
- Dispensing disk 130 large dispensing hole 132 and/or set of smaller holes 134 may be in the shape of a logo, picture, label, or some other decorative shape.
- Dispensing disk 130 section without holes 136 may include a logo, picture, label, or some other decorative shape.
- A design where surface attracted to a magnet 694 is magnetized and magnet 150 is made of metal for use with a magnet as opposed to being a permanent magnet.
- Designs where the dispensing closures components are made of one or more of a variety of materials including plastic, metal, wood, glass, ceramic, or some other rigid or semi-rigid material.
- A design where the dispensing closure further comprises a substantially cylindrical spacer 770 with a slightly larger thickness than the thickness of dispensing disk 130.
- A design where the closure base further comprises a substantially cylindrical spacer member 918 with a slightly larger thickness than the thickness of dispensing disk 130.
- A design where the closure base further comprises a threaded screw-band surface.

The advantages of the dispensing closure include, without limitation, the ability to store and easily dispense items within the jar 590 and then mount the jar 590 to a surface attracted to a magnet 694 to save space, provide easy access to the item, and use as an item of décor. The dispensing closure is more useful than most closures because it has a magnet mounted to its top that allows for storage on a surface attracted to a magnet 694. The dispensing closure's manual seal capability allows the jar assembly to be mounted on any surface in any orientation. Furthermore, the dispensing closure is designed to be used with the wide array of canning jars already available to consumers. Another advantage is that dispensing disk 130 may be designed so that the user can easily switch dispensing disks so as to customize the rate of flow of the item to be dispensed.

In broad embodiment, the present invention is a dispensing closure that dispenses items from a jar and that mounts the jar magnetically to a surface attracted to a magnet for storage and display.

While the foregoing written description of the invention enables one of ordinary skill to make and use what is considered presently to be the best mode thereof, those of ordinary skill will understand and appreciate the existence of variations, combinations, and equivalents of the specific embodiments, methods, and examples herein. The invention should therefore not be limited by the above described embodiments, methods, and examples, but by all embodiments and methods within the scope and spirit of the invention.

What is claimed is:

1. A dispensing closure provided for a container having a threaded neck portion terminating in an annular rim defining the periphery of an open mouth, said dispensing closure comprising the following:

a. a dispensing disk made of plastic, metal, wood, glass, ceramic or some other rigid or semi-rigid material with a plurality of sections and at least one section containing at least one hole and at least one section without a hole;

b. a closure base made of plastic, metal, wood, glass, ceramic or some other rigid or semi-rigid material with at least one hole and where said closure base further comprises a substantially cylindrical spacer where the thickness of said cylindrical spacer is slightly larger than the thickness of said dispensing disk;

c. a magnet;

d. fastening means for joining said base, said dispensing disk, and said magnet so as to hold said base, said dispensing disk, and said magnet together while also allowing for the rotation of said dispensing disk;

whereby said dispensing closure can be mounted onto ajar with ajar screw band, providing the capability to dispense items from the jar, and to manually seal and store the jar magnetically in a horizontal, vertical, or some-other-odd-angle orientation on any surface attracted to said magnet.

2. The dispensing closure in claim 1 where said substantially cylindrical spacer made of plastic, metal, wood, glass, ceramic or some other rigid or semi-rigid material is a separate entity from said closure base.

3. The dispensing closure in claim 1 wherein said fastening means may include a screw and threaded insert, screw and nut, rivet, brad, split pin, pin and clip, self-attaching fastener, or adhesive or some combination thereof.

4. The dispensing closure defined in claim 1 wherein said dispensing disk includes a large hole with a flat edge used to level a measuring spoon.

5. The dispensing closure defined in claim 1 wherein said base further comprising a threaded screw-band surface.

6. The dispensing closure defined in claim 1 wherein said base includes a recessed ring on its bottom surface in order to better form a seal with the jar.

7. The dispensing closure defined in claim 1 wherein said magnet is made of a material attracted to another magnet.

8. The dispensing closure defined in claim 1 wherein said fastening means may include a screw and threaded insert, screw and nut, rivet, brad, split pin, pin and clip, self-attaching fastener, or adhesive or some combination thereof and wherein said closure base includes a recessed ring on its bottom surface in order to better form a seal with the jar.

9. A dispensing closure provided for a container having a threaded neck portion terminating in an annular rim defining the periphery of an open mouth, said dispensing closure comprising the following:

a. a dispensing disk made of plastic, metal, wood, glass, ceramic or some other rigid or semi-rigid material with a plurality of sections and at least one section containing at least one hole and at least one section without a hole;

b. a closure base made of plastic, metal, wood, glass, ceramic or some other rigid or semi-rigid material with at least one hole and where said closure base further comprises a substantially cylindrical spacer where the thickness of said cylindrical spacer is slightly larger than the thickness of said dispensing disk;

c. a magnet;

d. a fastener for joining said base, said dispensing disk, and said magnet so as to hold said base, said dispensing disk, and said magnet together while also allowing for the rotation of said dispensing disk;

whereby said dispensing closure can be mounted onto ajar with a jar screw band, providing the capability to dispense items from the jar, and to manually seal and store the jar magnetically in a horizontal, vertical, or some-other-odd-angle orientation on any surface attracted to said magnet.

10. The dispensing closure in claim 9 where said substantially cylindrical spacer made of plastic, metal, wood, glass, ceramic or some other rigid or semi-rigid material is a separate entity from said closure base.

11. The dispensing closure in claim 9 wherein said fastener is a screw and threaded insert, screw and nut, rivet, brad, split pin, pin and clip, self-attaching fastener, or adhesive or some combination thereof.

12. The dispensing closure defined in claim 9 wherein said dispensing disk includes a large hole with a flat edge used to level a measuring spoon.

13. The dispensing closure defined in claim 9 wherein said base further comprising a threaded screw-band surface.

14. The dispensing closure defined in claim 9 wherein said base includes a recessed ring an its bottom surface in order to better form a seal with the jar.

15. The dispensing closure defined in claim 9 wherein said magnet is made of a material attracted to another magnet.

16. The dispensing closure defined in claim 9 wherein said fastener is a screw and threaded insert, screw and nut, rivet, brad, split pin, pin and clip, self-attaching fastener, or adhesive or some combination thereof and wherein said closure base includes a recessed ring on its bottom surface in order to better form a seal with the jar.

17. A dispensing closure provided for a container having a threaded neck portion terminating in an annular rim defining the periphery of an open mouth, said dispensing closure consisting of the following:

a. a closure base made of plastic, metal, wood, glass, ceramic, or some other rigid or semi-rigid material with at least one hole; with the closure base comprising a cylindrical spacer;

b. dispensing disk sits on top of said closure base; with the thickness of the cylindrical spacer being greater than the thickness of the dispensing disk;

c. a magnet;

d. fastening means for joining said base, said dispensing disk, and said magnet so as to hold said base, said dispensing disk, and said magnet together while also allowing for the rotation of said dispensing disk;

whereby said dispensing closure sits on top of and covers said open mouth of said container and is mounted with a jar screw band, providing the capability to dispense items from the jar, and to manually seal and store the jar magnetically in a horizontal, vertical, or some-other-odd-angle orientation on any surface attracted to said magnet.

18. The dispensing closure defined in claim 17 further comprising the substantially cylindrical spacer made of plastic, metal, wood, glass, ceramic, or some other rigid or semi-rigid material, and wherein said fastening means may include a screw and threaded insert screw and nut, rivet, brad, split pin, pin and clip, self-attaching fastener, or adhesive or some combination thereof and wherein said closure base includes a recessed ring on its bottom surface in order to better form a seal with the jar.

* * * * *